US009640193B2

(12) United States Patent
Kong

(10) Patent No.: US 9,640,193 B2
(45) Date of Patent: May 2, 2017

(54) SYSTEMS AND METHODS FOR ENHANCING PLACE-OF-ARTICULATION FEATURES IN FREQUENCY-LOWERED SPEECH

(71) Applicant: Ying-Yee Kong, Somerville, MA (US)

(72) Inventor: Ying-Yee Kong, Somerville, MA (US)

(73) Assignee: Northeastern University, Boston, MA (US)

( * ) Notice: Subject to any disclaimer, the term of this patent is extended or adjusted under 35 U.S.C. 154(b) by 0 days.

(21) Appl. No.: 14/355,458

(22) PCT Filed: Nov. 1, 2012

(86) PCT No.: PCT/US2012/063005

§ 371 (c)(1),
(2) Date: Apr. 30, 2014

(87) PCT Pub. No.: WO2013/067145

PCT Pub. Date: May 10, 2013

(65) Prior Publication Data

US 2014/0288938 A1 Sep. 25, 2014

Related U.S. Application Data

(60) Provisional application No. 61/555,720, filed on Nov. 4, 2011.

(51) Int. Cl.
*G10L 13/00* (2006.01)
*G10L 21/02* (2013.01)
(Continued)

(52) U.S. Cl.
CPC ..... *G10L 21/02* (2013.01); *G10L 21/003* (2013.01); *G10L 21/0364* (2013.01); *H04R 1/08* (2013.01);
(Continued)

(58) Field of Classification Search
None
See application file for complete search history.

(56) References Cited

U.S. PATENT DOCUMENTS 8,892,228 B2 * 11/2014 Muesch ..... G10L 19/005 381/73.1
9,305,559 B2 * 4/2016 Sharma ..... G10L 19/018
(Continued)

FOREIGN PATENT DOCUMENTS

WO WO-2007/006658 1/2007

OTHER PUBLICATIONS

Boersma, P. (2001). Praat, a system for doing phoenetics by computer. Glot International 5:9/10, 341-345.
(Continued)

*Primary Examiner* — Satwant Singh
(74) *Attorney, Agent, or Firm* — Hamilton, Brook, Smith & Reynolds, P.C.

(57) ABSTRACT

To improve the intelligibility of speech for users with high-frequency hearing loss, the present systems and methods provide an improved frequency lowering system with enhancement of spectral features responsive to place-of-articulation of the input speech. High frequency components of speech, such as fricatives, may be classified based on one or more features that distinguish place of articulation, including spectral slope, peak location, relative amplitudes in various frequency bands, or a combination of these or other such features. Responsive to the classification of the input speech, a signal or signals may be added to the input speech in a frequency band audible to the hearing-impaired listener, said signal or signals having predetermined distinct spectral features corresponding to the classification, and allowing a listener to easily distinguish various consonants in the input.

21 Claims, 12 Drawing Sheets

(51) Int. Cl.

| | |
|---|---|
| ***G10L 21/003*** | (2013.01) |
| ***G10L 21/0364*** | (2013.01) |
| ***H04R 1/08*** | (2006.01) |
| ***H04R 25/00*** | (2006.01) |
| *G10L 13/02* | (2013.01) |
| *G10L 25/18* | (2013.01) |
| *G10L 25/93* | (2013.01) |

(52) U.S. Cl.
CPC ..... *H04R 25/353* (2013.01); *G10L 13/02* (2013.01); *G10L 25/18* (2013.01); *G10L 25/93* (2013.01)

(56) References Cited

U.S. PATENT DOCUMENTS

| | | | | |
|---|---|---|---|---|
| 2002/0094100 | A1 | 7/2002 | Kates et al. | |
| 2008/0253593 | A1 | 10/2008 | Bramslow et al. | |
| 2009/0034768 | A1* | 2/2009 | Lunner ..... | H04R 25/453 381/318 |
| 2009/0226016 | A1 | 9/2009 | Fitz et al. | |
| 2010/0020988 | A1 | 1/2010 | McLeod | |
| 2011/0026739 | A1* | 2/2011 | Thomsen ..... | H03F 3/187 381/120 |
| 2011/0029109 | A1* | 2/2011 | Thomsen ..... | H03F 3/187 700/94 |
| 2014/0249812 | A1* | 9/2014 | Bou-Ghazale ..... | G10L 25/84 704/233 |

OTHER PUBLICATIONS

International Preliminary Report on Patentability on PCT/US2012/063005 dated May 15, 2014.

Reed, C.M., Hicks, B.L., Braida, L.D., Durlach, N.I., 1983. Discrimination of speech processed by low-pass filtering and pitch-invariant frequency lowering. J., Acoust. Soc. Amer. 74, 409-419.

Ali, A.M., Van def Spiegel, J., Mueller, P., Acoustic-phonetic features for the automatic classification of fricatives, Journal Acoust. Soc. Amer. 109, 2217-2235 (2001).

Baer, T., Moore, B.C., Kink, K., Effects of low pass filtering on the intelligibility of speech in noise for people with and without dead regions at high frequencies, Journal Acoust. Soc. Amer. 112, 1133-1144 (2002).

Beasley. D.S,. Mosher. N.L., Orchik. D.I, Use of frequency-shifted/time-compressed speech with hearing-impaired children, Audiology 15, 395-406 (1976).

Behrens, S., Blumstein, S.B., Acoustic characteristics of English voiceless fricatives: a descriptive analysis, J. Phonetics 16, 295-298 (1988).

Behrens, S., Blumstein, S.E., On the role of the amplitude of the fricative noise in the perception of place of articulation in voiceless fricative consonants, J. Acoust. Soc. Amer. 84, 861-867 (1988).

Braida, L.D., Durlach, N.L, Lippmann, R.P., Hicks, M.L., Rabinowitz, W.M., Reed, C.M., Hearing aids: a review of past research on linear amplification, amplitude compression, and frequency lowering. ASHA Monograph No. 19 (1979).

Dudley, H., Remaking speech, J. Acoust. Soc. Amer. 11, 165 (1939).

Fox, R.A., Nissen, S.L., Sex-related acoustic changes in voiceless English fricatives. J. Speech Lang. Hear. Res. 48, 753-765 (2005).

Harris, K.S., Cues for the discrimination of American English fricatives in spoken syllables. Lang. Speech 1, 1-17 (1958).

Henry, B.A., McDermott, H.J., McKay, C.M., James, C.J, Clark, G.M., A frequency importance function for a new monosyllabic word test, Austral. J. Audiol. 20, 79-86 (1998).

Hogan, C.A., Turner, C.W., High-frequency audibility: Benefits for hearing-impaired listeners. J. Acoust. Soc. Amer., 104, 432-441 (1998).

Hughes, G.W., Halle, M., Spectral properties of fricative consonants. J. Acoust. Soc. Amer. 28, 303-310 (1956).

International Search Report & Written Opinion on PCT/US2012/063005 dated Mar. 25, 2013.

Jongman, A., Wayland, R., Wong, S., Acoustic characteristics of English fricatives. J. Acoust. Soc. Amer. 108, 1252-1263 (2000).

Kong, Y-Y., Braida, L.D., Cross-frequency integration for consonant and vowel identification in bimodal hearing. J. Speech Lang. Hear. Res. 54, 959-980 (2011).

Korhonen, P., Kuk, F., Use of linear frequency transposition in simulated hearing loss. J. Amer. Acad. Audiol. 19,639-650 (2008).

Kuk, F., Keenan, D., Korhonen, P., Lau, C.-C., Efficacy of linear frequency transposition on consonant identification in quiet and in noise. J. Amer. Acad. Audiol. 20, 465-479 (2009).

Lippmann, R.P., Perception of frequency lowered speech. J. Acoust. Soc. Amer. 67, S78 (1980).

Maniwa, K., Jongman, A., Wade, T., Acoustic characteristics of clearly spoken English fricatives. J. Acoust. Soc. Amer, 125, 3962-3973 (2009).

McDermott, H., Henshall, K., The use of frequency compression by cochlear implant recipients with postoperative acoustic hearing. J. Amer. Acad. Audiol. 21, 380-389 (2010).

McDermott, H.J., Dean, M.R., Speech perception with steeply sloping hearing loss: effects of frequency transposition. Br. J. Audiol. 34, 353-361 (2000).

Miller, G.A., Nicely, P.R., An analysis of perceptual confusion among some English consonants. J. Acoust. Soc. Amer. 27, 338-352 (1955).

Moore, F.R., Elements of Computer Music, Prentice-Hall, Englewood Cliffs, NJ, pp. 227-229 and 246263 (1990).

Nissen, S.L., Fox, R.A., Acoustic and spectral characteristics of young children's fricative productions: a developmental perspective, J. Acoust. Soc. Amer. 118, 2570-2578 (2005).

Nittrouer, S., Studdert~Kennedy, M., McGowan, R.S., The emergence of phonetic segments: evidence from the spectral structure of fricative-vowel syllables spoken by children and adults. J. Speech Hear. Res. 32, 120-132 (1989).

Onaka, A., Watson, C.I., Acoustic comparison of child and adult fricatives. In: 8th Aust. International Conf. On Speech Science and Technology, pp. 134-139 (2000).

Posen, M.P., Reed, C.M., Braida, L.D., Intelligibility of frequency-lowered speech produced by a channel vocoder. J. Rehabil. Res. Dev. 30, 26-38 (1993).

Reed, C.M., Power, M.H., Durlach, N.I., Braida, L.D. Foss, K.K., Reid, J.A., Dubois, S.R., Development and testing of artificial low-frequency speech codes. J. Rehabil., Res., Dev. 28, 6782 (1991).

Robinson, J,D., Baer, T., Moore, B.C., Using transposition to improve consonant discrimination and detection for listeners with severe high-frequency hearing loss. Int. J. Audiol. 46, 293-308 (2007).

Shannon, R.V., Jensvold, A., Padilla, M., Robert, M.E., Wang, X., Consonant recordings for speech testing. J. Acoust. Soc., Amer. 106, L71-L74 (1999).

Simpson, A, Frequency-lowering devices for managing high-frequency hearing loss: A review. Trends Amplif. 13, 87-106 (2009).

Simpson, A., Hersbach, A.A., McDermott, H.J., Improvements in speech perception with an experimental nonlinear frequency compression hearing device. Int. J. Audiol. 44, 281-292 (2005).

Simpson, A., Hersbach, A.A., McDermott, H.J., Frequency-compression outcomes in listeners with steeply sloping audiograms. Int. J. Audiol. 45, 619-629 (2006).

Stelmachowicz, P.G., Pittman, A.L., Hoover, B.M., Lewis, D.E., Moeller, M.P., The importance of high-frequency audibility in the speech and language development of children with hearing loss. Arch. Otolaryngol. Head Neck Surg. 130, 556-562 (2004).

Turner, C.W., Hurtig, R.R., Proportional frequency compression of speech for listeners with sensorineural hearing loss. J. Acoust. Soc. Amer. 106, 877-886 (1999).

Velmans, M., Speech imitation in simulated deafness, using visual cues and 'recoded' auditory information. Lang. Speech 16, 224-236 (1973).

Velmans, M., The design of speech recording devices for the deaf. Br. J. Audiol. 8, 1-5 (1974).

(56) References Cited

OTHER PUBLICATIONS

Wolfe, J., John, A, Schafer, E., Nyffeler, M., Boretzki, M., Caraway, T., Evaluation of nonlinear frequency compression for school-age children with moderate to moderately severe hearing loss. J. Am. Acad. Audiol. 21, 618-62S (2010).
Wolfe, J., John, A., Schafer, E., Nyffeler, M., Boretzki, M., Caraway, T., Hudson, M., Long-term effects of non-linear frequency compression for children with moderate hearing loss, Intl. J. Audiol. 50, 396-404 (2011).

* cited by examiner

SYSTEMS AND METHODS FOR ENHANCING PLACE-OF-ARTICULATION FEATURES IN FREQUENCY-LOWERED SPEECH

CROSS-REFERENCE TO RELATED PATENT APPLICATIONS

This application claims the benefit of and is a U.S. national application of International Application No. PCT/US2012/063005, entitled "Systems and Methods for Enhancing Place-of-Articulation Features in Frequency-Lowered Speech," filed Nov. 1, 2012; which claims the benefit of and priority to U.S. Provisional Patent Application 61/555,720, filed Nov. 4, 2011, each of which are incorporated herein by reference in its entirety.

BACKGROUND OF THE DISCLOSURE

High-frequency sensorineural hearing loss is the most common type of hearing loss. Recognition of speech sounds that are dominated by high-frequency information, such as fricatives and affricates, is challenging for listeners with this hearing-loss configuration. Furthermore, perception of place of articulation is difficult because listeners rely on high-frequency spectral cues for the place distinction, especially for fricative and affricative consonants or stops. Individuals with a steeply sloping severe-to-profound (>70 dB HL) high-frequency hearing loss may receive limited benefit for speech perception from conventional amplification at high frequencies.

SUMMARY OF THE DISCLOSURE

To improve the intelligibility of speech for users with high-frequency hearing loss, the present systems and methods provide an improved frequency lowering system with enhancement of spectral features responsive to place-of-articulation of the input speech. High frequency components of speech, such as fricatives, may be classified based on one or more features that distinguish place of articulation, including spectral slope, peak location, relative amplitudes in various frequency bands, or a combination of these or other such features. Responsive to the classification of the input speech, a signal or signals may be added to the input speech in a frequency band audible to the hearing-impaired listener, said signal or signals having predetermined distinct spectral features corresponding to the classification, and allowing a listener to easily distinguish various consonants in the input. These systems may be implemented in hearing aids, or in smart phones, computing devices providing Voice-over-IP (VoIP) communications, assisted hearing systems at entertainment venues, or any other such environment or device.

In one aspect, the present disclosure is directed to a method for frequency-lowering of audio signals for improved speech perception. The method includes receiving, by an analysis module of a device, a first audio signal. The method also includes detecting, by the analysis module, one or more spectral characteristics of the first audio signal. The method further includes classifying, by the analysis module, the first audio signal, based on the detected one or more spectral characteristics of the first audio signal. The method also includes selecting, by a synthesis module of the device, a second audio signal from a plurality of audio signals, responsive to at least the classification of the first audio signal. The method further includes combining, by the synthesis module of the device, at least a portion of the first audio signal with the second audio signal for output.

In one embodiment, the method includes detecting a spectral slope or a peak location of the first audio signal. In another embodiment, the method includes identifying amplitudes of energy of the first audio signal in one or more predetermined frequency bands. In still another embodiment, the method includes detecting one or more temporal characteristics of the first audio signal to identify periodicity of the first audio signal in one or more predetermined frequency bands. In still yet another embodiment, the method includes classifying the first audio signal as non-sonorant based on identifying that the first audio signal comprises an aperiodic signal above a predetermined frequency.

In some embodiments, the method includes classifying the first audio signal as non-sonorant based on analyzing amplitudes of energy of the first audio signal in one or more predetermined frequency bands. In other embodiments, the first audio signal comprises a non-sonorant sound, and the method includes classifying the non-sonorant sound in the first audio signal as one of a predetermined plurality of groups having distinct spectral characteristics. In a further embodiment, the method includes classifying the non-sonorant sound in the first audio signal as belonging to a first group of the predetermined plurality of groups, based on a spectral slope of the first audio signal not exceeding a threshold. In another further embodiment, the method includes classifying the non-sonorant sound in the first audio signal as belonging to a second group of the predetermined plurality of groups, based on a spectral slope of the first audio signal exceeding a threshold and a spectral peak location of the first audio signal not exceeding a second threshold. In still yet another further embodiment, the method includes classifying the non-sonorant sound in the first audio signal as belonging to a third group of the predetermined plurality of groups, based on a spectral slope of the first audio signal exceeding a threshold and a spectral peak location of the first audio signal above a predetermined frequency exceeding a second threshold. In yet still another further embodiment, the method includes classifying the non-sonorant sound in the first audio signal as belonging to a first, second, or third group of the predetermined plurality of groups, based on amplitudes of energy of the first audio signal in one or more predetermined frequency bands.

In one embodiment, the first audio signal comprises a non-sonorant sound, and the method includes selecting the second audio signal from the plurality of audio signals responsive to the classification of the non-sonorant sound in the first audio signal, each of the plurality of audio signals having a different spectral shape. In a further embodiment, each of the plurality of audio signals comprises a plurality of noise signals, and the spectral shape of each of the plurality of audio signals is based on the relative amplitudes of each of the plurality of noise signals at a plurality of predetermined frequencies. In another further embodiment, the method includes selecting an audio signal of the plurality of audio signals having a spectral shape corresponding to spectral features of the non-sonorant sound in the first audio signal.

In some embodiments, the first audio signal comprises a non-sonorant sound, and the second audio signal has an amplitude proportional to a portion of the first audio signal above a predetermined frequency. In a further embodiment, a portion of the second audio signal includes spectral content below a portion of the first audio signal above a predetermined frequency. In one embodiment, the method further includes receiving, by the analysis module, a third audio signal. The method also includes detecting, by the analysis module, one or more spectral characteristics of the third audio signal. The method also includes classifying, by the analysis module, the third audio signal as a sonorant sound, based on the detected one or more spectral characteristics of the third audio signal. The method further includes outputting the third audio signal without performing a frequency lowering process.

In another aspect, the present disclosure is directed to a system for improving speech perception. The system includes a first transducer for receiving a first audio signal. The system also includes an analysis module configured for: detecting one or more spectral characteristics of the first audio signal, and classifying the first audio signal, based on the detected one or more spectral characteristics of the first audio signal. The system also includes a synthesis module configured for: selecting a second audio signal from a plurality of audio signals, responsive to at least the classification of the first audio signal, and combining at least a portion of the first audio signal with the second audio signal for output. The system further includes a second transducer for outputting the combined audio signal.

In one embodiment of the system, the analysis module is further configured for detecting a spectral slope or a peak location of the first audio signal. In another embodiment of the system, the analysis module is further configured for identifying amplitudes of energy of the first audio signal in one or more predetermined frequency bands. In yet another embodiment of the system, the analysis module is further configured for detecting one or more temporal characteristics of the first audio signal to identify periodicity of the first audio signal in one or more predetermined frequency bands. In still yet another embodiment of the system, the analysis module is further configured for classifying the first audio signal as non-sonorant based on identifying that the first audio signal comprises an aperiodic signal above a predetermined frequency. In yet still another embodiment of the system, the analysis module is further configured for classifying the first audio signal as non-sonorant based on analyzing amplitudes of energy of the first audio signal in one or more predetermined frequency bands.

In some embodiments of the system, the first audio signal comprises a non-sonorant sound. The analysis module is further configured for classifying the non-sonorant sound in the first audio signal as one of a predetermined plurality of groups having distinct spectral characteristics. In a further embodiment of the system, the analysis module is further configured for classifying the non-sonorant sound in the first audio signal as belonging to a first group of the predetermined plurality of groups, based on a spectral slope of the first audio signal not exceeding a threshold. In another further embodiment of the system, the analysis module is further configured for classifying the non-sonorant sound in the first audio signal as belonging to a second group of the predetermined plurality of groups, based on a spectral slope of the first audio signal exceeding a threshold and a spectral peak location of the first audio signal not exceeding a second threshold. In yet another further embodiment of the system, the analysis module is further configured for classifying the non-sonorant sound in the first audio signal as belonging to a third group of the predetermined plurality of groups, based on a spectral slope of the first audio signal exceeding a threshold and a spectral peak location of the first audio signal above a predetermined frequency exceeding a second threshold. In still yet another further embodiment of the system, the analysis module is further configured for classifying the non-sonorant sound in the first audio signal as belonging to a first, second, or third group of the predetermined plurality of groups, based on amplitudes of energy of the first audio signal in one or more predetermined frequency bands.

In other embodiments of the system, the first audio signal comprises a non-sonorant sound, and the synthesis module is further configured for selecting the second audio signal from the plurality of audio signals responsive to the classification of the non-sonorant sound in the first audio signal, each of the plurality of audio signals having a different spectral shape. In a further embodiment, each of the plurality of audio signals comprises a plurality of noise signals, and the spectral shape of each of the plurality of audio signals is based on the relative amplitudes of each of the plurality of noise signals at a plurality of predetermined frequencies. In another further embodiment, the synthesis module is further configured for selecting an audio signal of the plurality of audio signals having a spectral shape corresponding to spectral features of the non-sonorant sound in the first audio signal.

In still other embodiments of the system, the first audio signal comprises a non-sonorant sound, and the synthesis module is further configured for combining at least a portion of the non-sonorant sound in the first audio signal with the second audio signal, the second audio signal having an amplitude proportional to a portion of the first audio signal above a predetermined frequency. In a further embodiment, a portion of the second audio signal includes spectral content below a portion of the first audio signal above a predetermined frequency.

In another embodiment of the system, the analysis module is further configured for: receiving a third audio signal, detecting one or more spectral characteristics of the third audio signal, and classifying the third audio signal as a sonorant sound, based on the detected one or more spectral characteristics of the third audio signal. The system outputs the third audio signal via the second transducer without performing a frequency lowering processing.

BRIEF DESCRIPTION OF THE DRAWINGS

The skilled artisan will understand that the figures, described herein, are for illustration purposes only. It is to be understood that in some instances various aspects of the described implementations may be shown exaggerated or enlarged to facilitate an understanding of the described implementations. In the drawings, like reference characters generally refer to like features, functionally similar and/or structurally similar elements throughout the various drawings. The drawings are not necessarily to scale, emphasis instead being placed upon illustrating the principles of the teachings. The drawings are not intended to limit the scope of the present teachings in any way. The system and method may be better understood from the following illustrative description with reference to the following drawings in which.

DETAILED DESCRIPTION

The various concepts introduced above and discussed in greater detail below may be implemented in any of numerous ways, as the described concepts are not limited to any particular manner of implementation. Examples of specific implementations and applications are provided primarily for illustrative purposes.

The overall system and methods described herein generally relate to a system and method for frequency-lowering of audio signals for improved speech perception. The system detects and classifies sonorants and non-sonorants in a first audio signal. Based on the classification of non-sonorant consonants, the system applies a specific synthesized audio signal to the first audio signal. The specific synthesized audio signals are designed to improve speech perception by conditionally transposing the frequency content of an audio signal into a range that can be perceived by a user with a hearing impairment, as well as providing distinct features corresponding to each classified non-sonorant sound, allowing the user to identify and distinguish consonants in the speech.

Figure 1:
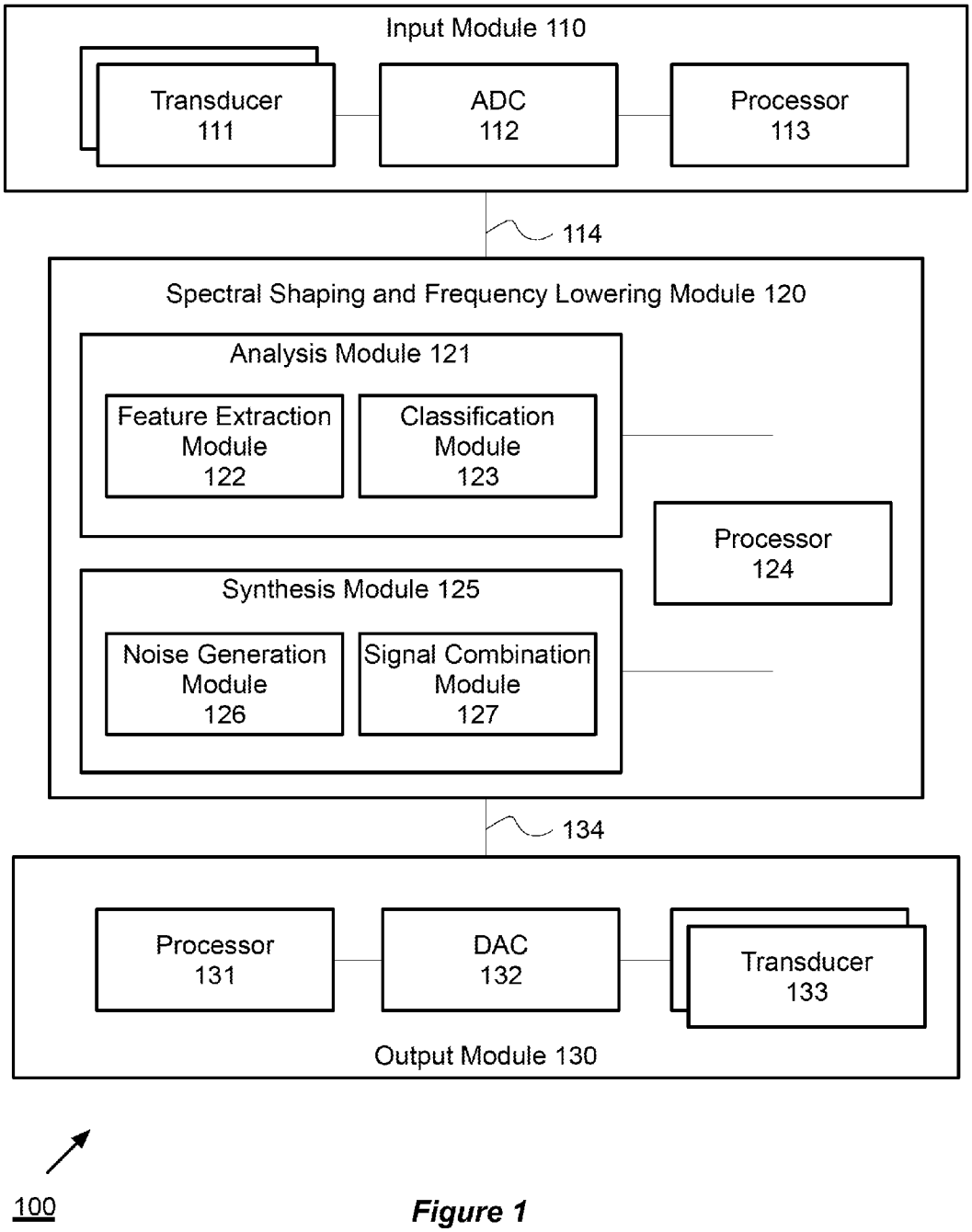
FIG. 1 is a block diagram of a system for frequency-lowering of audio signals for improved speech perception, according to one illustrative embodiment.

FIG. 1 illustrates a system 100 for frequency-lowering of audio signals for improved speech perception. The system 100 includes three general modules, each comprising a plurality of subcomponents and submodules. Although shown separate, each module may be within the same or different devices, and accordingly in such embodiments, duplicate parts may be removed (e.g. processors). Input module 110 comprises one or more transducers 111 for receiving acoustic signals, an analog to digital converter 112 and a first processor 113. The input module 110 interfaces with a spectral shaping and frequency lowering module 120 via a connection 114. The spectral shaping and frequency lowering module 120 may comprise a second processor 124, or in embodiments in which modules 110, 120 are within the same device, may utilize the first processor 113. The processor 124 is in communication with an analysis module 121, which further comprises a feature extraction module 122 and a classification module 123. Additionally, the processor 124 is in communication with a synthesis module 125, which further comprises a noise generation module 126 and a signal combination module 127. The spectral shaping and frequency lowering module 120 interfaces with the third general module, an output module 130, via a connection 134. In the output module, the processor 131 converts an output digital signal into an analog signal with a digital to analog converter 132. The resulting analog signal is then converted into an acoustic signal by the second set of transducers 133.

The system 100 includes at least one transducer 111 in the input module 110. The transducer 111 converts acoustical energy into an analog signal. In some embodiments, the transducer 111 is a microphone. There is no limitation to the type of transducer that can be used in system 100. For example, the transducer 111 can be, but is not limited to, dynamic microphones, condenser microphones, and/or piezoelectric microphones. In some embodiments, the plurality of transducers 111 are all the same type of transducer. In other embodiments, the at least one transducer can be a plurality of types of transducers. In some embodiments, the transducers 111 are configured to detect human speech. In some embodiments, at least one of the transducers 111 is configured to detect background noise. For example, the system 100 can be configured to have two transducers. The first transducer 111 is configured to detect human speech, and the second transducer 111 is configured to detect background noise. The signal from the transducer 111 collecting background noise can then be used to remove unwanted background noise from the signal of the transducer configured to detect human speech. In some embodiments, the transducer 111 may be the microphone of a telephone, cellular phone, smart phone, headset microphone, computer microphone, or microphone on similar devices. In other embodiments, the transducer 111 may be a microphone of a hearing aid, and may either be located within an in-ear element or may be located in a remote enclosure.

After being converted from acoustical energy into an analog signal, the analog to digital converter (ADC) 112 of system 110 converts the analog signal into a digital signal. In some implementations, the sampling rate of the ADC 112 is between about 20 kHz and 25 kHz. In other implementations, the sampling rate of the ADC 112 is greater than 25 kHz, and in other embodiments, the sampling rate of the ADC 112 is less than 20 kHz. In some embodiments, the ADC 112 is configured to have a 8, 10, 12, 14, 16, 18, 20, 24, or 32 bit resolution.

The system 100 as shown has a plurality of processors 113,124, and 133 in each of the general modules. However, as discussed above, in some embodiments, system 100 only contains one or two processors. In these embodiments, the one or two processors of system 100 are configured to control more than one of the general modules at a time. For example, in a hearing aid, each of the three general modules may be housed in a single device or in a device with a remote pickup and an in-ear element. In such an example, a central processor would control the input module 110, spectral shaping and frequency lowering module 120, and the output module 130. In contrast, in the example of a phone system, the input module 110, with a first processor, could be located in a first location (e.g., the receiver of a first phone), and the spectral shaping and frequency lowering module 120 and output module 130, with a second processor, could be located in a second location (e.g., the headset of a smart phone). In some embodiments, the processor is a specialized microprocessor such as a digital signal processor. In some embodiments, the processors contains an analog to digital converter and/or a digital to analog converter, and performs the function of the analog to digital converter 112 and/or digital to analog converter 132.

The spectral shaping and frequency lowering module 120 of system 100 analyzes, enhances, and transposes the frequencies of an acoustic signal captured by the input module 110. As described above, the spectral shaping and frequency lowering module comprises a processor 124. Additionally, the spectral shaping and frequency lowering module 120 comprises an analysis module 121. The submodules of the spectral shaping and frequency lowering module are described in further detail below.

Briefly, the feature extraction module 122 receives a digital signal from the input module 110. The feature extraction module 122 is further configured to detect and extract high-frequency periodic signals, and to analyze amplitudes of energy of the input signal from bands of filters. The feature extraction module 122 then passes the extracted signals to the classification module 123. Feature extraction module 122 may comprise one or more filters, including high pass filters, low pass filters, band pass filters, notch filters, peak filters, or any other type and form of filter. Feature extraction module 122 may comprise delays for performing frequency specific cancellation, or may include functionality for noise reduction. The classification module 123 is configured to classify the signals as corresponding to distinct predetermined groups: group 1 may include non-sibilant fricatives, affricates, and stops; group 2 may include palatal sibilant fricatives, affricates, and stops; and group 3 may include alveolar sibilant fricatives, affricates, and stops; group 4 may include sonorant sounds (e.g., vowels, semi-vowels, and nasals).

The analysis module 121 passes the classification to the synthesis module 125. Based on the characterization of each signal, the noise generation module 126 generates a predefined, low-frequency signal, which may be modulated by the envelope of the input audio, and which is then combined with the input signal in the signal combination module 127, which may comprise summing amplifiers or a summing algorithm. Although referred to as noise generation, noise generation module 126 may comprise one or more of any type and form of signal generators generating and/or filtering white noise, pink noise, brown noise, sine waves, triangle waves, square waves, or other signals. Noise generation module 126 may comprise a sampler, and may output a sampled signal, which maybe further filtered or combined with other signals.

In some embodiments, the submodules of the spectral shaping and frequency lowering module 120 are programs executing on a processor. Some embodiments lack the analog to digital converter 112 and digital to analog converter 132, and the function of the submodules and modules are performed by analog hardware components. In yet other embodiments, the function of the modules and submodules are performed by both software and hardware components.

The combined signal, a combination of the original signal and the added low-frequency signal is then passed to the third general module, the output module 130. In the output module a processor, as described above, passes the new signal to a digital to analog converter 132. In some embodiments, the digital to analog converter 132 is a portion of the processor, and in other implementations the digital to analog converter 132 is a stand alone integrated circuit. After the new signal is converted to an analog signal, it is passed to the at least one transducer 133.

The at least one transducer 133, of system 100, converts the combined signal into an acoustic signal. In some embodiments, the at least one transducer 133 is a speaker. The plurality of transducers 133 can be the same type of transducer or different types of transducers. For example, in a system with two transducers 133, the first transducer may be configured to produce low-frequency signals, and the second transducer may be configured to produce high-frequency signals. In such an example, the output signal may be split between the two transducers, wherein the low-frequency components of the signal are sent to the first transducer and the high-frequency components of the signal are sent to the second transducer. In some embodiments, the signal is amplified before being transmitted out of system 100. In other embodiments, the transducer is a part of a stimulating electrode for a cochlear implant. Additionally, the transducer can be a bone conducting transducer.

The general modules of system 100 are connected by connection 114 and connection 134. The connections 114 and 134 can include a plurality of connection types. In some embodiments, the three general modules are housed within a single unit. In such embodiments, the modules can be, but are not limited to, connections such as electrical traces on a printed circuit board, point-to-point connections, any other type of direct electrical connection, and/or any combination thereof. In some embodiments, the general modules are connected by optical fibers. In yet other embodiments, the general modules are connected wireless. For example, by Bluetooth or radio-frequency communication. In yet other embodiments, the general modules can be divided between two or three separate entities. In these embodiments, the connection 114 and connection 134 can be an electrical connection, as described above; a telephone network; a computer network, such as a local area network (LAN), a wide area network (WAN), wireless area network, intranets; and other communication networks such as mobile telephone networks, the Internet, or a combination thereof.

In contrast to the hearing aid example above, in some examples, the general modules of system 100 are divided between two entities. For example, the system 100 could be implemented in a smart phone. As described above, the input module would be located in a first phone and the spectral shaping and frequency lowering module 120 and output module 130 would be located in the smart phone of the user.

In other embodiments, all three general modules are located separately from one another. For example, in a call-in service the input module 110 would be a first phone, the output module 130 would be a second phone, and the spectral shaping and frequency lowering module 120 would be located in the call-in service's data centers. In this example, a person with a hearing impairment would call the call-in service. The user would relay the telephone number of their desired contact to the call-in service, which would then connect the parties. During the phone call, the call-in service would intercept the signal from the desired contact to the user, and perform the functions of the spectral shaping and frequency lowering module 120 on the signal. The call-in service would then pass the modified signal to the hearing impaired user.

Figure 2A:
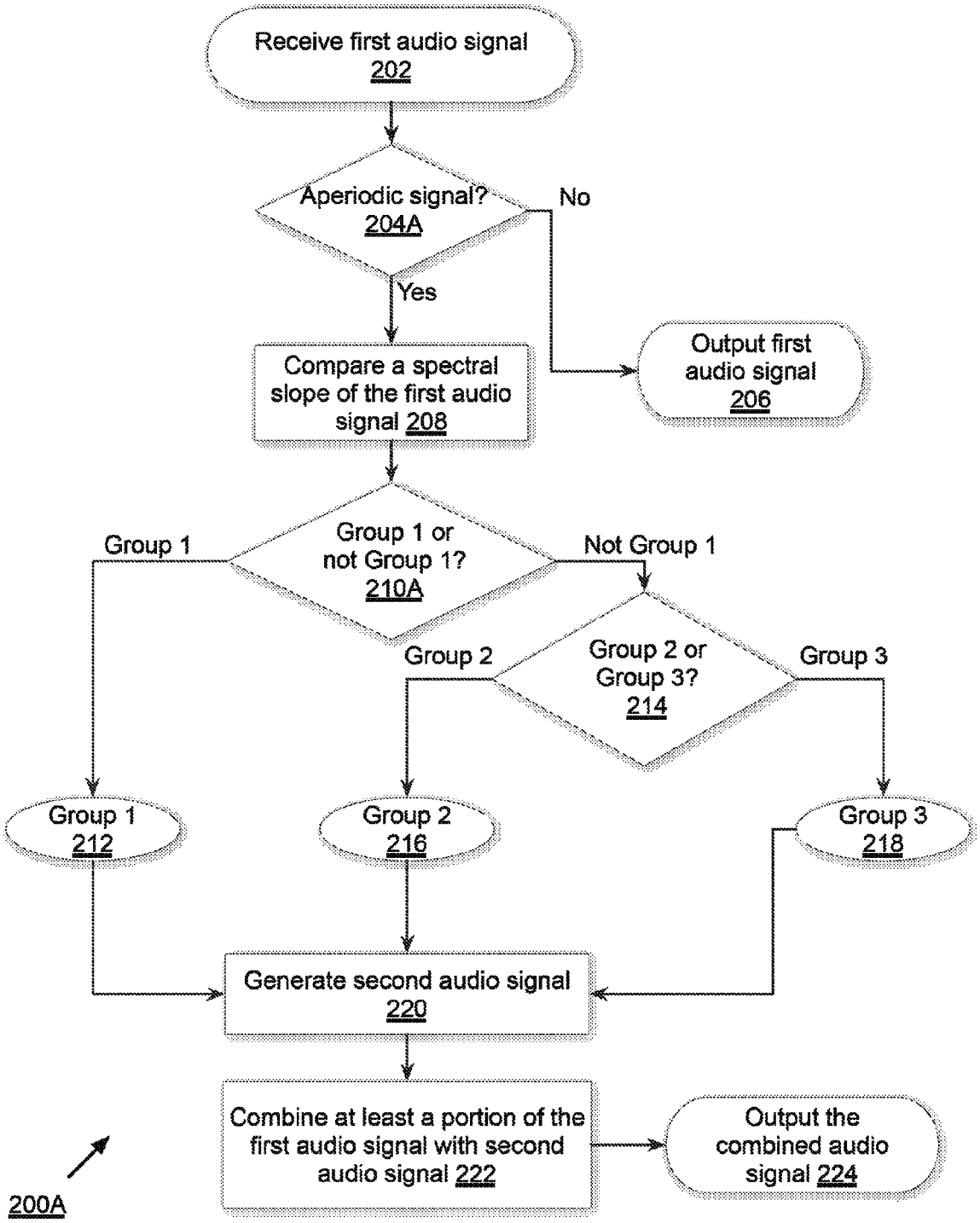
FIGS. 2A-2D are flow charts of several embodiments of methods for frequency-lowering of audio signals for improved speech perception.

FIG. 2A is a flow chart of a method for frequency-lowering of audio signals for improved speech perception which includes a spectral shaping and frequency lowering module 120 similar to that of system 100 described above. A first audio signal is received (step 202). The system determines if the signal is aperiodic above a predetermined frequency (step 204A). The first audio signal with an aperiodic component in high frequencies is considered as a non-sonorant sound, whereas that with a periodic component in high frequencies is considered as a sonorant sound. No further processing is done to sonorant sounds (step 206), while the spectral slope of aperiodic signals are compared to a threshold (step 208). Next, the non-sonorant sounds are classified as belonging to group 1, comprising various types of non-sibilant fricatives, affricates, stops or similar signals, or not group 1 (step 210A). Signals not belonging to group 1 are then classified as belonging to group 2, comprising palatal fricatives, affricates, stops or similar signals, or group 3, comprising alveolar fricatives, affricates, stops or similar signals (step 214). A second audio signal is selected corresponding to the group classification and generated (step 220), and combined with the first audio signal (step 222). Finally, the combined audio signal is output (step 224).

As set forth above, the method of frequency-lowering of audio signals for improved speech perception begins by receiving a first audio signal (step 202). In some embodiments, at least one transducer 111 receives a first audio signal. As described above, in some embodiments, a plurality of transducers 111 receive a first audio signal. For example, each transducer can be configured to capture specific characteristics of the first audio signal. The signals captured from the plurality of transducers 111 can then be added and/or subtracted from each other to provide an optimized audio signal for later processing. In some embodiments, the audio signal is received by the system as a digital or an analog signal. In some embodiments, the audio signal is preconditioned after being received. For example, high-pass, low-pass, and/or band-pass filters can be applied to the signal to remove or reduce unwanted components of the signal.

Next, the method 200A continues by detecting if the signal contains aperiodic segments above a predetermined frequency (step 204A). The frequency-lowering processing is conditional, in which the frequency-lowering is performed on consonant sounds classified as non-sonorants. The non-sonorants are classified by detecting high-frequency energy that comprises aperiodic signals, as some of the voiced non-sonorant sounds are periodic at low frequencies. For example, a high-frequency signal can be a signal above 300, 400, 500, or 600 Hz. In some embodiments, the aperiodic nature of the signal is detected with an autocorrelation-based pitch extraction algorithm. In this example, the first audio signal is analyzed in 40 ms Hamming windows, with a 10 ms time step. Consecutive 10 ms output frames are compared. If the two neighboring windows contain different periodicity detection results the system classifies the two windows as aperiodic. Alternatively, or additionally, different window types, window size and step size could be used. In some embodiments, there could be no overlap between analyzed windows.

The method 200A continues by outputting the first audio signal if it is determined to not be an aperiodic signal above a predetermined frequency (step 206). However, if the first audio signal is determined to contain an aperiodic signal above a predetermined frequency, then the spectral slope of the first audio signal is compared to a predetermined threshold value (step 208). In some embodiments, the spectral slope is calculated passing the first audio signal through twenty contiguous one-third octave filters with standard center frequencies in the range of from about 100 Hz to about 10 kHz. Then the output of each band of the one-third octave filters or a subset of the bands can be fitted with a linear regression line.

After plotting the spectral slope, the method 200A continues at step 210A by comparing the slope to a set threshold to determine if the first audio signal belongs to a first group, comprising non-sibilant fricatives, stops, and affricates (group 212). In some embodiments, the slope of the linear regression line is analyzed between a first frequency, such as 800 Hz, 1000 Hz, 1200 Hz, or any other such values, and a second frequency, such as 4800 Hz, 5000 Hz, 5200 Hz, or any other such values. In some embodiments, a substantially flat slope, such as a slope of less than approximately 0.003 dB/Hz, can be used to distinguish the sibilant and non-sibilant fricative signals, although other slope thresholds may be utilized. In some embodiments, the slope threshold remains constant, while in other embodiments, the slope threshold is continually updated based on past data.

Next, at step 214, the method 200A further classifies the signals not belonging to group 1 as belonging to group 2, comprising palatal fricatives, affricates, stops or similar signals (group 216), or group 3, comprising alveolar fricatives, affricates, stops or similar signals (group 218). In some embodiments, the groups are distinguished by spectrally analyzing the first audio signal, and determining the location of a spectral peak of the signal, or a frequency at which the signal has its highest amplitude. In some embodiments, the peak can be located anywhere in the entire frequency spectrum of the signal. In other embodiments, a signal may have multiple peaks, and the system may analyze a specific spectrum of the signal to find a local peak. For example, in some embodiments, the local peak is found between a first frequency and a second, higher frequency, the two frequencies bounding a range that typically contains energy corresponding to sibilant or non-sonorant sounds, such as approximately 1 kHz to 10 kHz, although other values may be used. After determining the location of the spectral peak, it is compared to a predetermined frequency threshold value. In some embodiments, the threshold is set to an intermediate frequency between the first frequency and second frequency, such as 5 kHz, 6 kHz, or 7 kHz. A signal including a spectral peak below the intermediate frequency can be classified as belonging to group 2 (216), and a signal including a spectral peak above the intermediate frequency may be classified as belonging to group 3 (218).

After classifying the input signal as belonging to group 1, 2, or 3, the method 200A continues by generating a second audio signal (step 220). Discussed further in relational to FIG. 3 below, but briefly, the system 100 generates a specific and distinct second audio signal for each of the classified groups. In some embodiments, the second audio signal is selected to further distinguish the groups to an end user and improve speech perception. In some embodiments, the second audio signal predominately contains noise below a set frequency threshold. For example, in some embodiments, the noise patterns do not contain noise above about 800 Hz, 1000 Hz, or 1300 Hz, such that the noise patterns will be easily audible to a user with high frequency hearing loss. In some embodiments, the highest frequency included in the second audio signal is based on the hearing impairment of the end user. In some embodiments, the second audio signal is subdivided into a specific number of bands. For example, the second audio signal can be generated via four predetermined bands. In other examples, the second audio signal can be divided into six specific bands. Again, this delineation can be based on the end user's hearing impairment. Each of the bands can be generated by a low-frequency synthesis filter, as a noise filtered via a bandpass filter. In other embodiments, the second audio signal may comprise tonal signals, such as distinct chords for each classified group. In some embodiments, the output level of a synthesis filter band is proportional to the input level of its corresponding analysis band, such that the envelope of the generated second audio signal is related to the envelope of the high frequency input signal.

The method 200A concludes by combining at least a portion of the first audio signal with the second audio signal (step 222) and then outputting the combined audio signal (step 224). In some embodiments, the portion of the first audio signal and the second audio signal are combined digitally. The portion may comprise the entire first audio signal, or the first audio signal may be filtered via a low-pass filter to remove high frequency content. This may be done to avoid spurious difference frequencies or interference that may be audible to a hearing impaired user, despite their inability to hear the high frequencies directly. In other embodiments, the signals are converted to analog signals and then the analog signals are combined and output by the transducers 133.

Figure 2B:
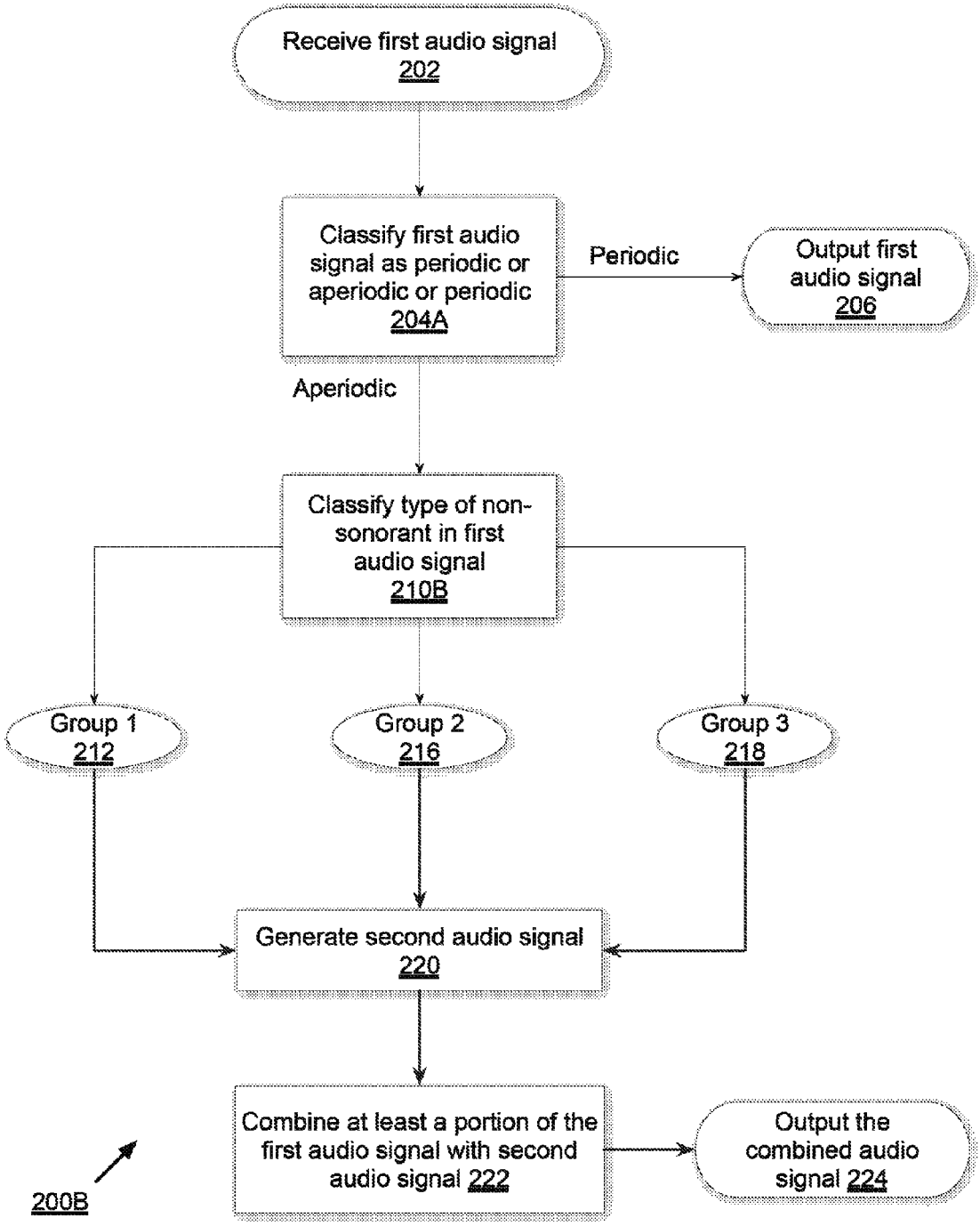

FIG. 2B is a flow chart of another method of frequency-lowering and spectrally enhancing acoustic signals in a spectral shaping and frequency lowering module 120 similar to that of system 100 described above. Method 200B is similar to method 200A above; however, embodiments of the method 200B differ in how the first audio signal is classified. In the method of 200B, system 100 first determines if the first audio signal is aperiodic above a predetermined frequency (step 204A). The first audio signal with an aperiodic component in high frequencies is considered as a non-sonorant sound, whereas that with a periodic component in high frequencies is considered as a sonorant sound. The method 200B continues by outputting the first audio signal if it is determined to be a sonorant sound (step 206). However, if the first audio signal is determined to be a non-sonorant sound, it is then classified at step 210B as corresponding to group 1 (212), group 2 (216), or group 3 (218), as discussed above. The method 200B then concludes similar to method 200A by generating a second audio signal (step 220), combining the signals (step 222), and the outputting the combined signal (step 224).

Focusing on the classification steps of method 200B, first a portion of the first audio signal is classified as periodic or aperiodic above a predetermined frequency (step 204A).

Next, method 200B continues by classifying the non-sonorant sounds as corresponding to group 1 (212), including non-sibilant fricatives, affricates, stops or similar signals; group 2 (216), comprising palatal fricatives, affricates, stops or similar signals; or group 3 (218), comprising alveolar fricatives, affricates, stops or similar signals (step 210B). The non-sonorant sounds of the first signal are fed into a classification algorithm, which groups the portions into one of the three above-mentioned classifications. In some embodiments, the non-sonorant sounds can be classified by a classification algorithm. For example, a Linear Discrimination Analysis can be preformed to group the non-sonorant sounds into three groups. In other implementations, the classification algorithm can be, but is not limited to, a machine learning algorithm, support vector machine, and/or artificial neural network. In some embodiments, the portions of the first audio signal are band-pass filtered with twenty one-third octave filters with center frequencies from about 100 Hz, 120 Hz, or 140 Hz, or any similar first frequency, to approximately 9 kHz, 10 kHz, 11 kHz or any other similar second frequency. At least one of the outputs from these filters may be used as the input into the classification algorithm. For example, in some embodiments, eight filter outputs can be used as inputs into the classification algorithm. In some embodiments, the filters may be selected from the full spectral range, and in other embodiments, the filters were selected only from the high frequency portion of the signal. For example, eight filter outputs ranging from about 2000 Hz to 10 kHz can be used as input into the classification algorithm. In some embodiments, the filter outputs are normalized. In some embodiments, the thresholds used by the classification algorithm are hard coded and in other embodiments, algorithms are trained to meet specific requirements of an end user. In other embodiments, the inputs can be, but are not limited to, wavelet power, Teager energy, and mean energy.

Figure 2C:
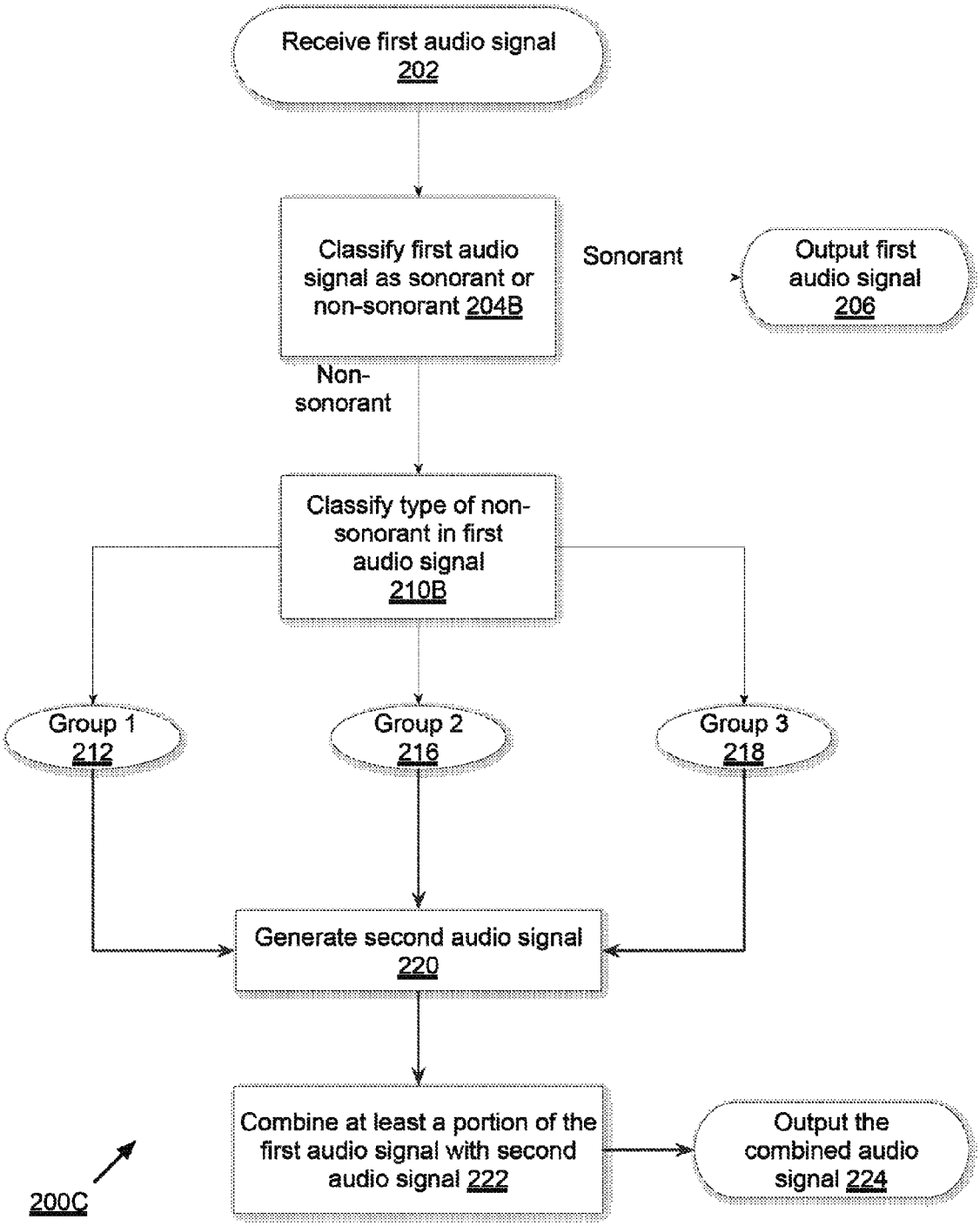

FIG. 2C illustrates a flow chart of an embodiment of method 200C for frequency-lowering and spectrally enhancing acoustic signals, similar to method 200B. In some embodiments, at step 204B, the system may classify a signal as sonorant or non-sonorant using one or more spectral and/or temporal features (e.g., periodicity in the signal above a predetermined frequency). For example, the system may classify a signal as sonorant or non-sonorant responsive to relative amplitudes at one or more frequency bands, spectral slope within one or more frequency bands, or other such features. For example, a Linear Discrimination Analysis may identify other distinct features between a sonorant and non-sonorant beyond periodicity and utilize these other distinct features to classify a signal. In other implementations, the classification algorithm can be, but is not limited to, a machine learning algorithm, support vector machine, and/or artificial neural network.

Figure 2D:
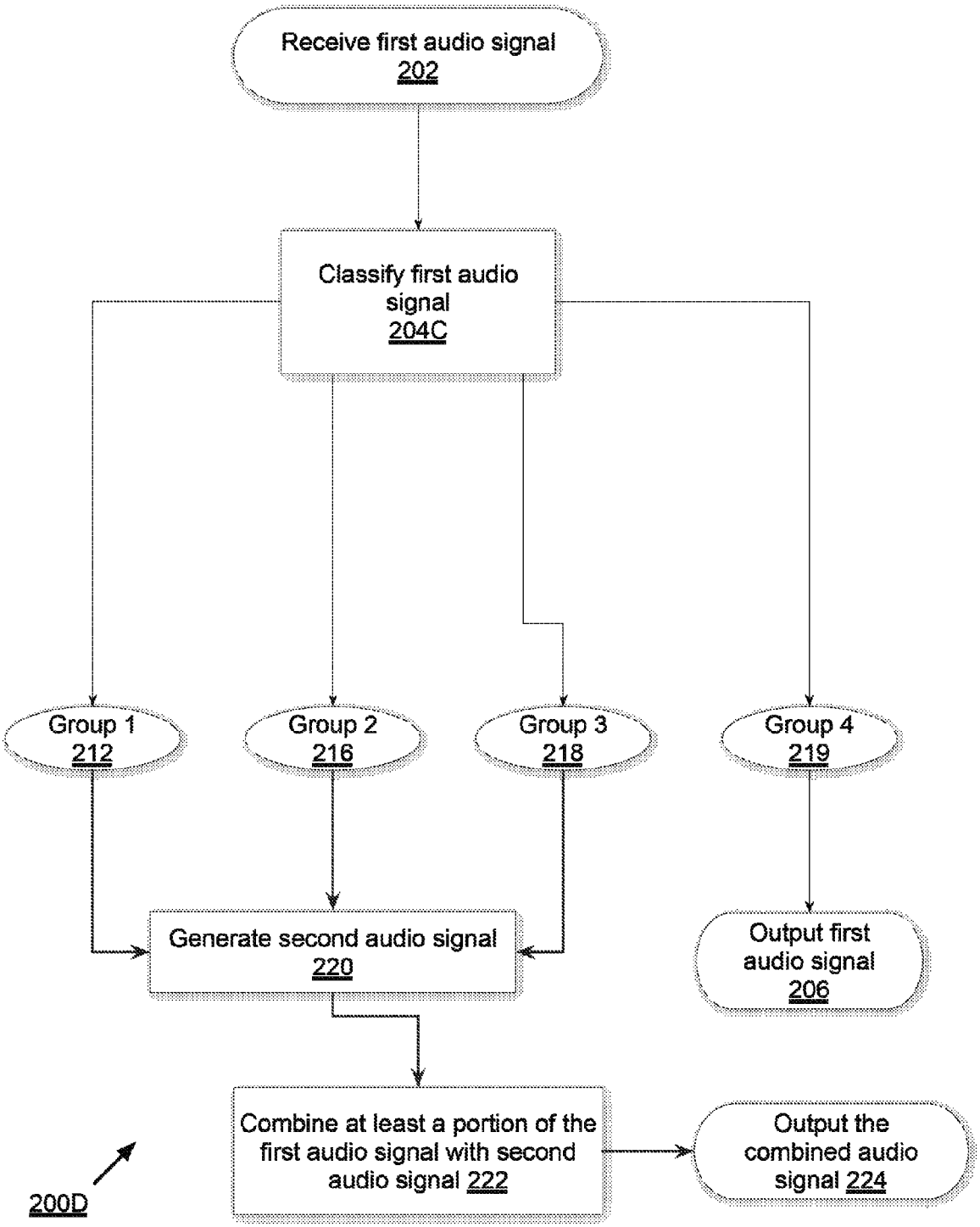

Similarly, FIG. 2D illustrates a flow chart of an embodiment of method 200D for frequency-lowering and spectrally enhancing acoustic signals using a single classification step, 204C. In such embodiments, the classification algorithm is capable of distinguishing sonorants, which may be classified as belonging to a fourth group, group 4 (219); as well as non-sibilant fricatives, affricates, and stops, palatal fricatives, affricates, and stops, and alveolar fricatives, affricates, and stops belonging to groups 1, 2 and 3 (212-218), respectively. As discussed above, a signal classified as belonging to group 4 (219) may be output directly at step 206 without performing a signal enhancement or frequency lowering process.

Figure 3:
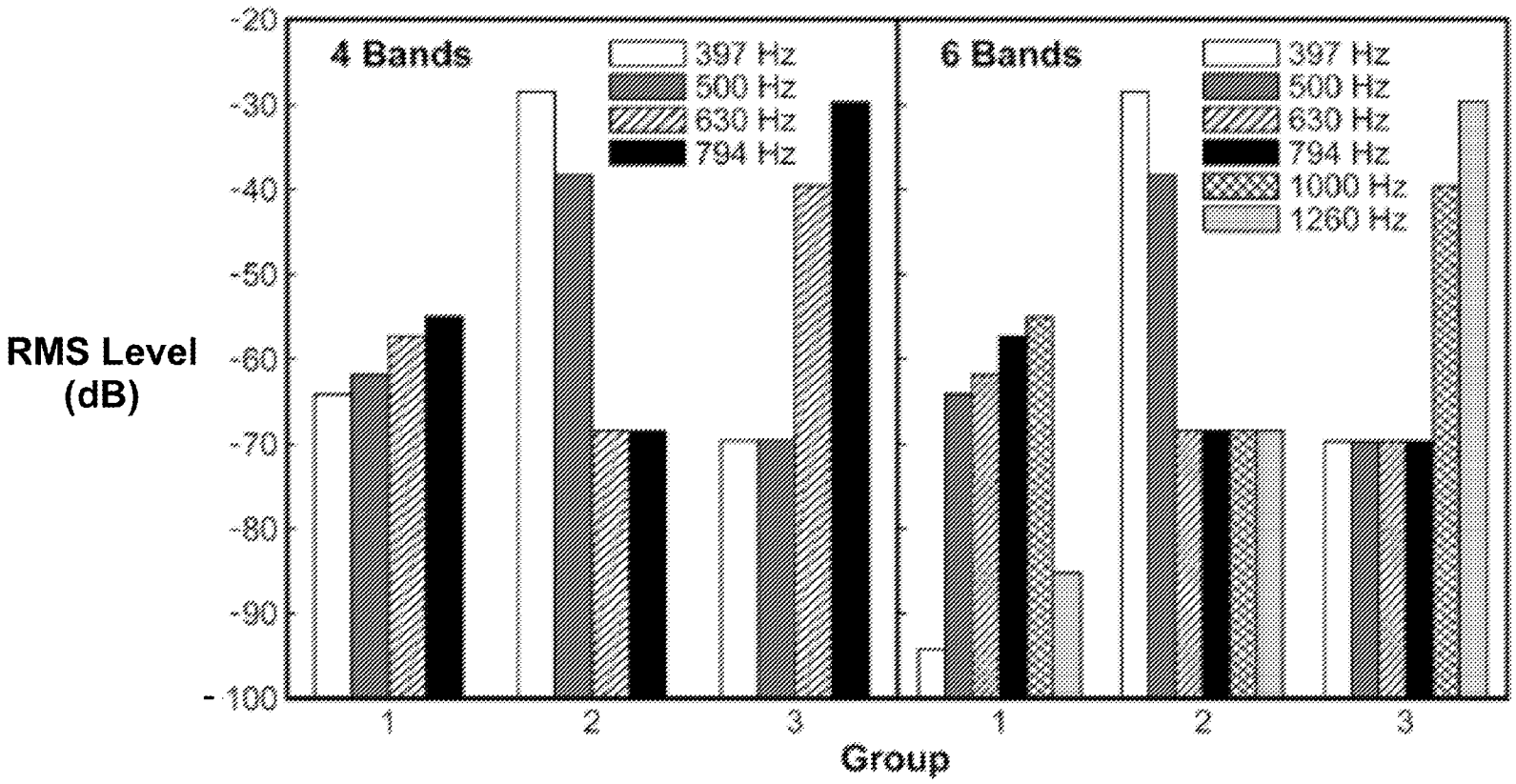
FIG. 3 is a plot of exemplary low-frequency synthesis signals comprising a plurality of noise signals, according to one illustrative embodiment.

As described above in relation to step 220 of methods 200A-200D, system 100 generates a specific second audio signal pattern. The pattern is combined with the first audio signal or a portion of the first audio signal, as discussed above. FIG. 3 illustrates the relative noise levels for a plurality of low-frequency synthesis bands, as can be used in step 220. As described above, in some embodiments, the number of noise bands can be dependent on an end user's hearing capabilities. For example, as illustrated in FIG. 3, if the end user has an impairment above 1000 Hz, the noise bands may be limited to four bands below 1000 Hz; however; if an end user's impairment begins at about 1500 Hz, two additional bands may be added to take advantage of the end user's expanded hearing capabilities. In some embodiments, the bands have center frequencies of about 400, 500, 630, 790, 1000, and 1200 Hz, though similar or different frequencies may be used. Additionally, in some embodiments, the bands may be tonal rather than noise. For example, a major chord may be used to identify a first fricative and a minor chord may be used to identify a second fricative, or various harmonic signals may be used, including square waves, sawtooth waves, or other distinctive signals. FIG. 3 also illustrates that each generated signal corresponding to a group has a unique, predetermined spectral pattern.

Figure 4:
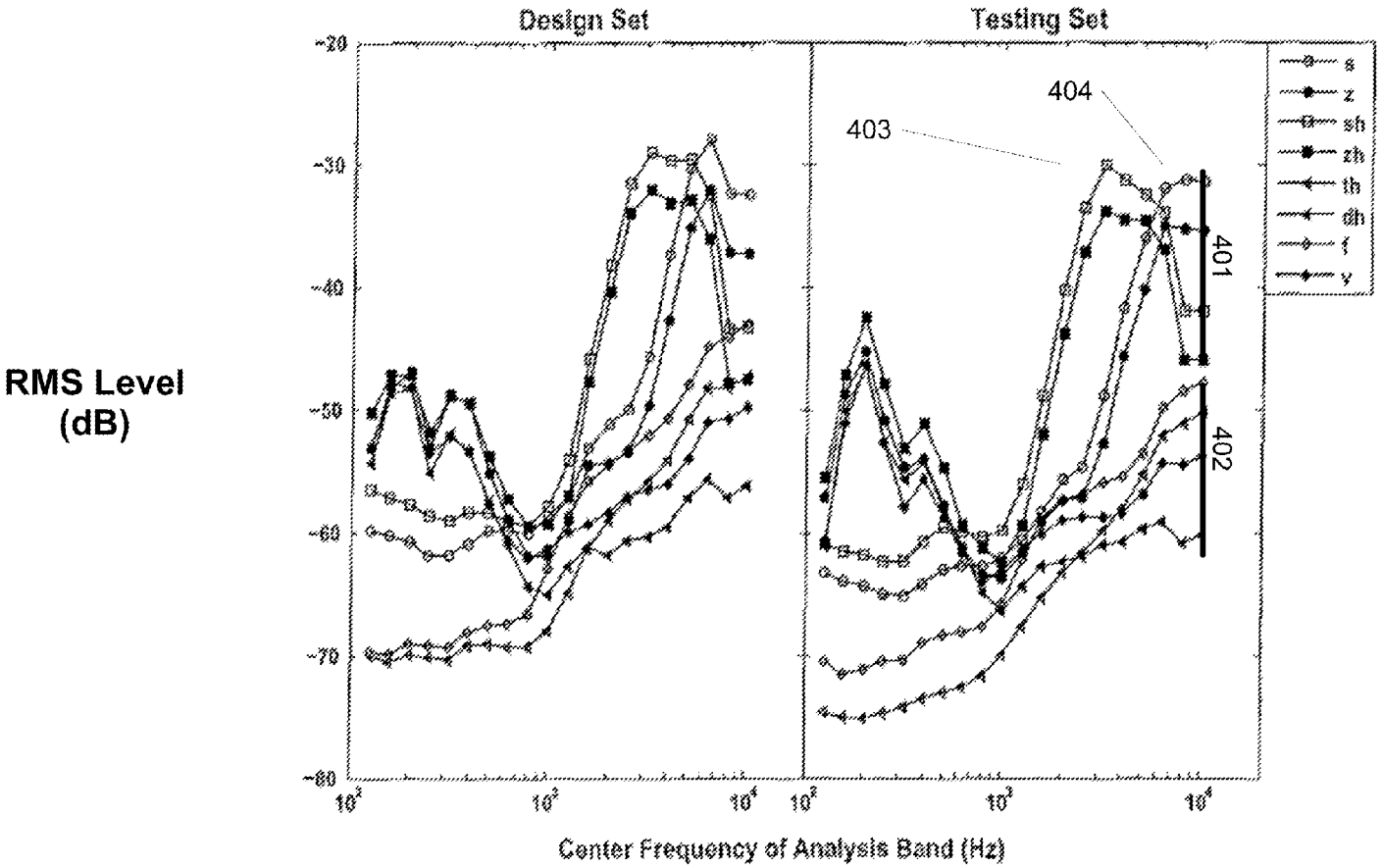
FIG. 4 is an example plot of analysis of relative amplitudes of various fricatives at frequency bands from 100 Hz to 10 kHz, illustrating distinct spectral slopes and spectral peak locations, according to one illustrative embodiment.

As described in regards to steps 208-214 of FIG. 2A, spectral slope and spectral peak location can be used to classify the portions of the audio signals. For example, FIG. 4 illustrates plots of exemplary outputs of twenty one-third octave filters with various fricatives as inputs. As shown, non-sibilant fricatives 402 and sibilant fricatives 401 frequently have different slopes in the range between 1 kHz and 10 kHz when plotting the output of the one-third octave filters. Additionally, peak spectral location of the alveolar fricatives 404 may occur at a higher frequency than the peak spectral location of the palatal fricatives 403.

Example Trial 1

Identification of Fricative Consonants

Example 1 illustrates the benefit of processing a first audio signal consisting of fricative consonants with a frequency lowering system with enhanced place of articulation features, such as that of system 100. The trial included six hearing-impaired subjects ranging from 14 to 58 years of age. The subjects were each exposed to 432 audio signals consisting of one of eight fricative consonants (/f, θ, s, ʃ, v, ð, z, 3/). Subjects were tested using conventional amplification and frequency lowering with wideband and low-pass filtered speech. A list of eight fricative consonants was displayed to the subject. Upon being exposed to an audio signal, the subject would select the fricative consonant they heard.

Figure 5:
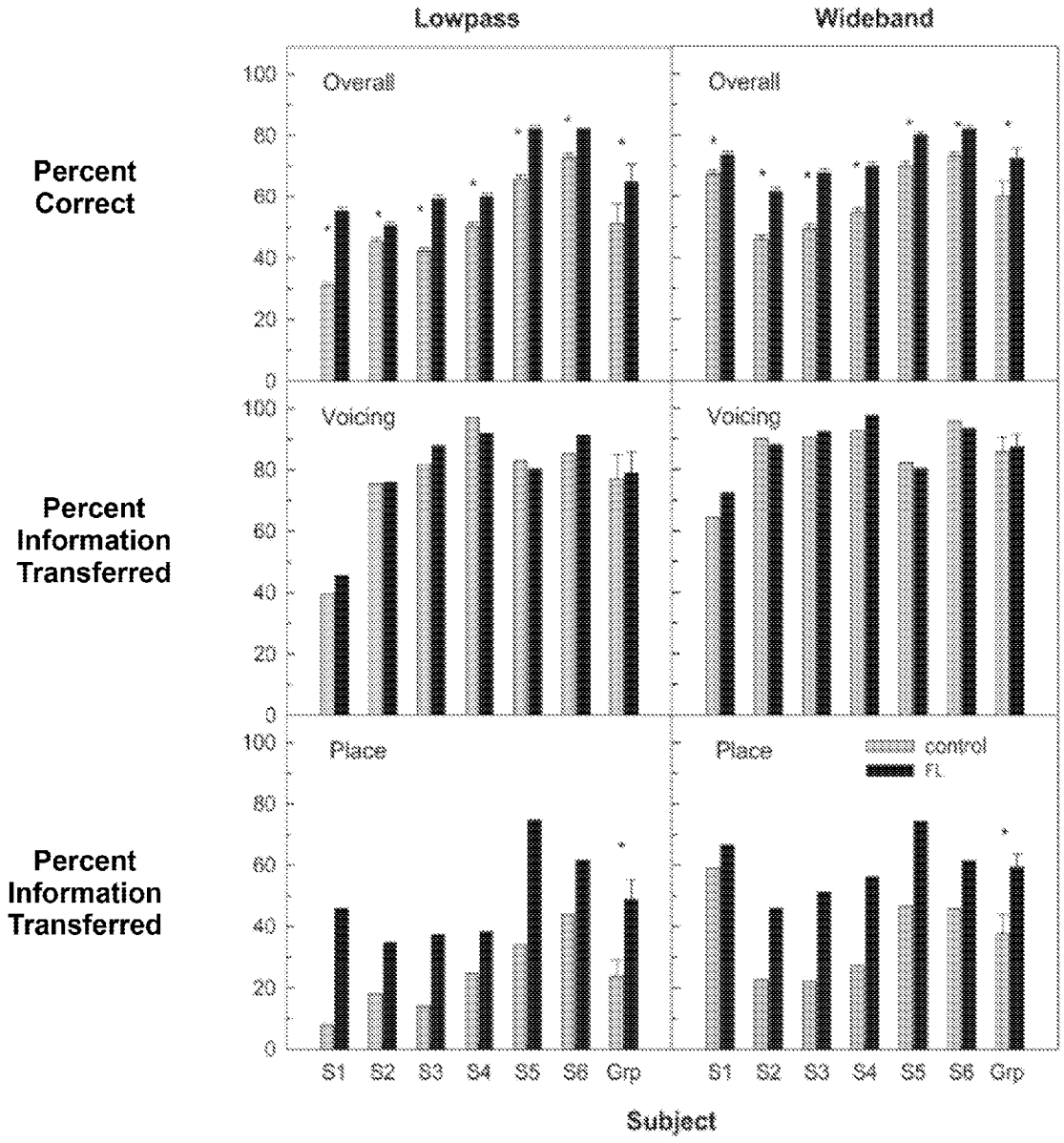
FIG. 5 is a chart summarizing the percent of correct fricatives identified by subjects when audio signals containing only fricative sounds were passed through a system as depicted in FIG. 1, according to one illustrative embodiment.

FIG. 5 illustrates the results of this experiment. FIG. 5 shows all subjects experienced a statistically significant improvement in the number of consonants they were accurately able to identify when audio signal was passed through a system similar to system 100. The primary improvement came in place of articulation perception, allowing subjects to distinguish the fricatives. Additionally, all subjects experienced improvements in both wideband and low-pass filtered conditions.

Example Trial 2

Identification of Consonants

Example 2 illustrates the benefit of processing a first audio signal containing groups of consonants with a frequency lowering system, such as that of system 100. This trial expanded upon trial 1 by including other classes of consonant sounds such as stops, affricates, nasals, and semi-vowels. The subjects were exposed test sets consisting of audio signals containing /VCV/ utterances with three vowels (/a, i, and u/). Each stimulus was processed with a system similar to system 100 described above. The processed and unprocessed signals were also low-pass filtered with a filter having a cutoff frequency of 1000 Hz, 1500 Hz, or 2000 Hz.

Figure 6:
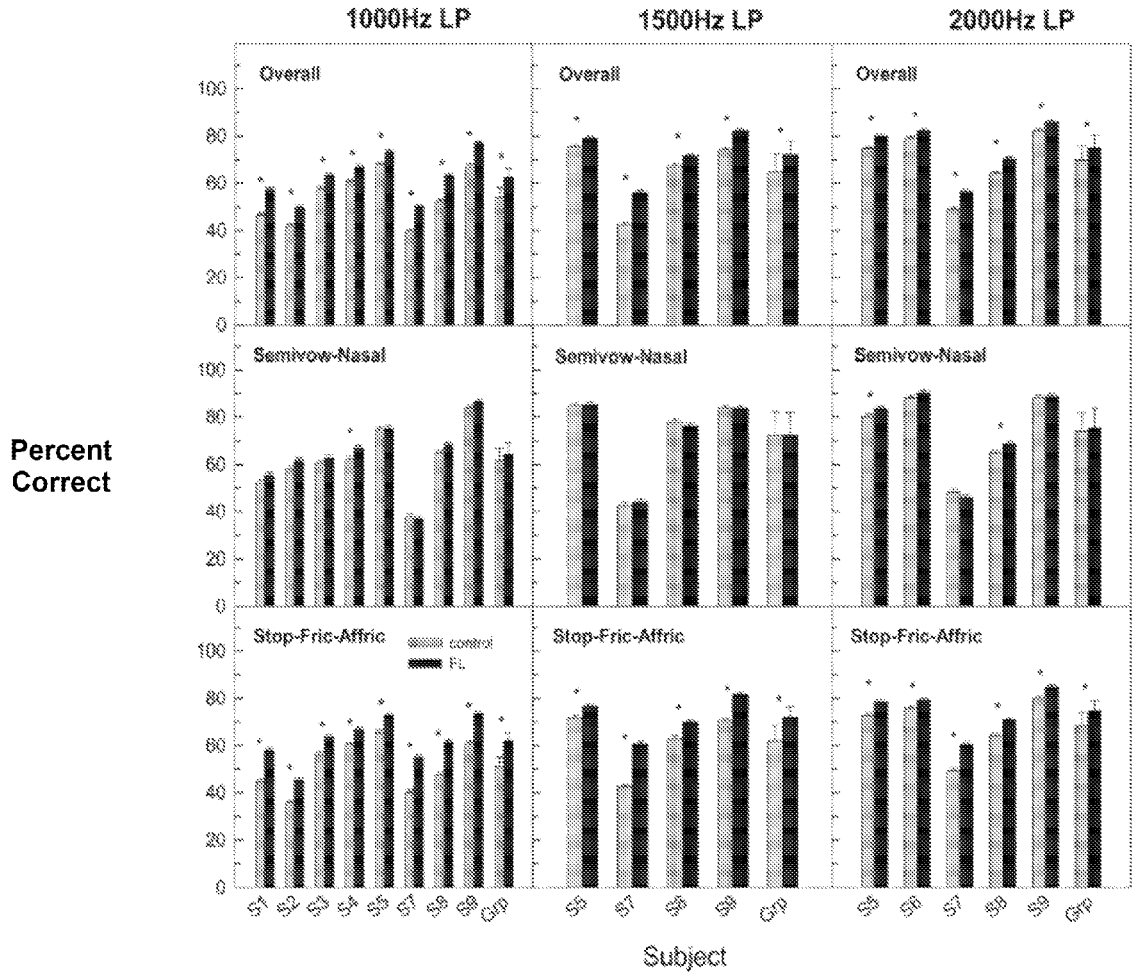
FIG. 6 is a chart summarizing the percent of correct consonants identified by subjects when audio signals contained sonorant and non-sonorant sounds were passed through a system as depicted in FIG. 1, according to one illustrative embodiment.
Figure 7A:
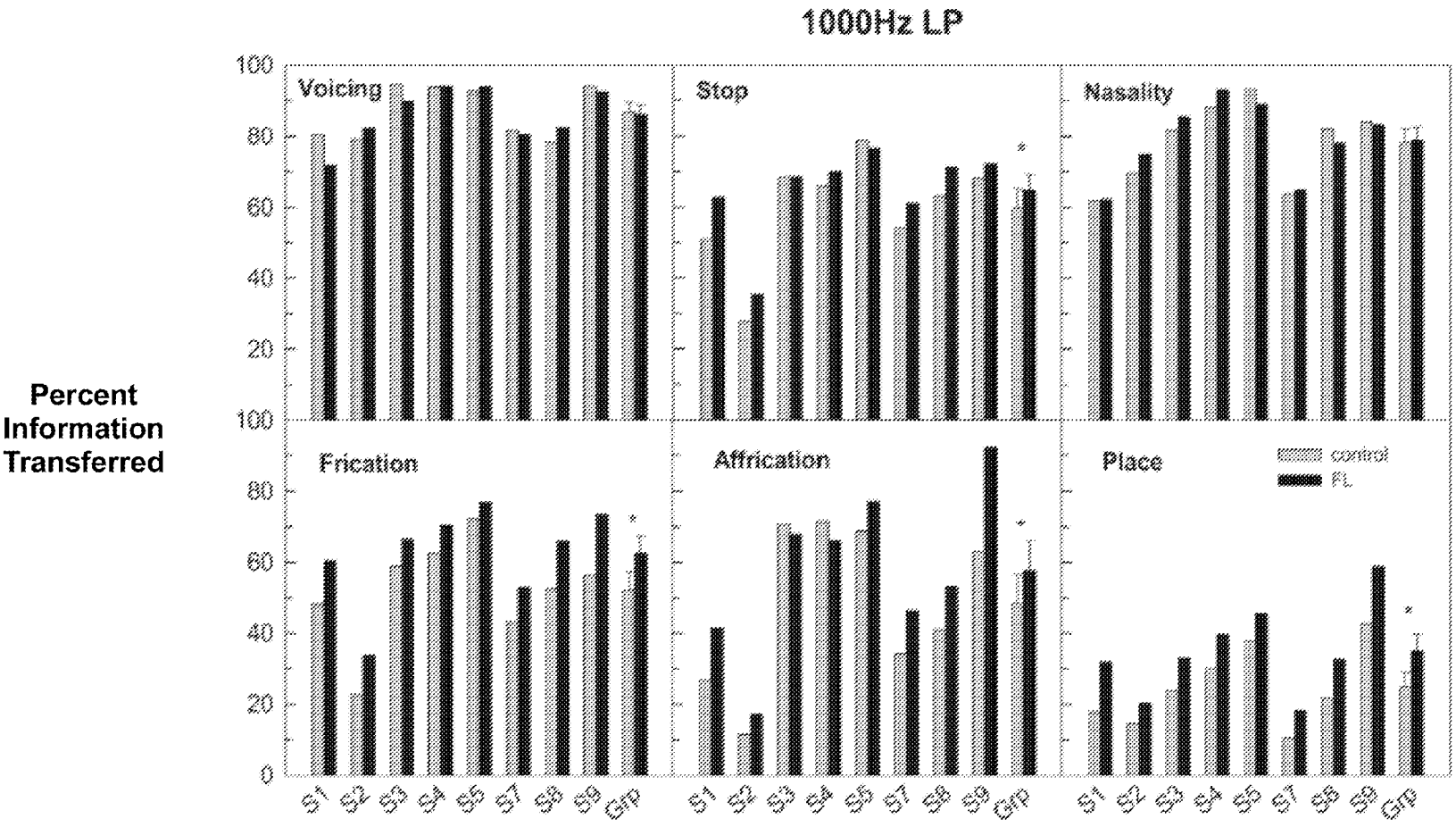
FIGS. 7A-7C are charts illustrating the percent of information transmitted for six consonant features when audio signals contained sonorant and non-sonorant sounds were passed through a system as depicted in FIG. 1.
Figure 7B:
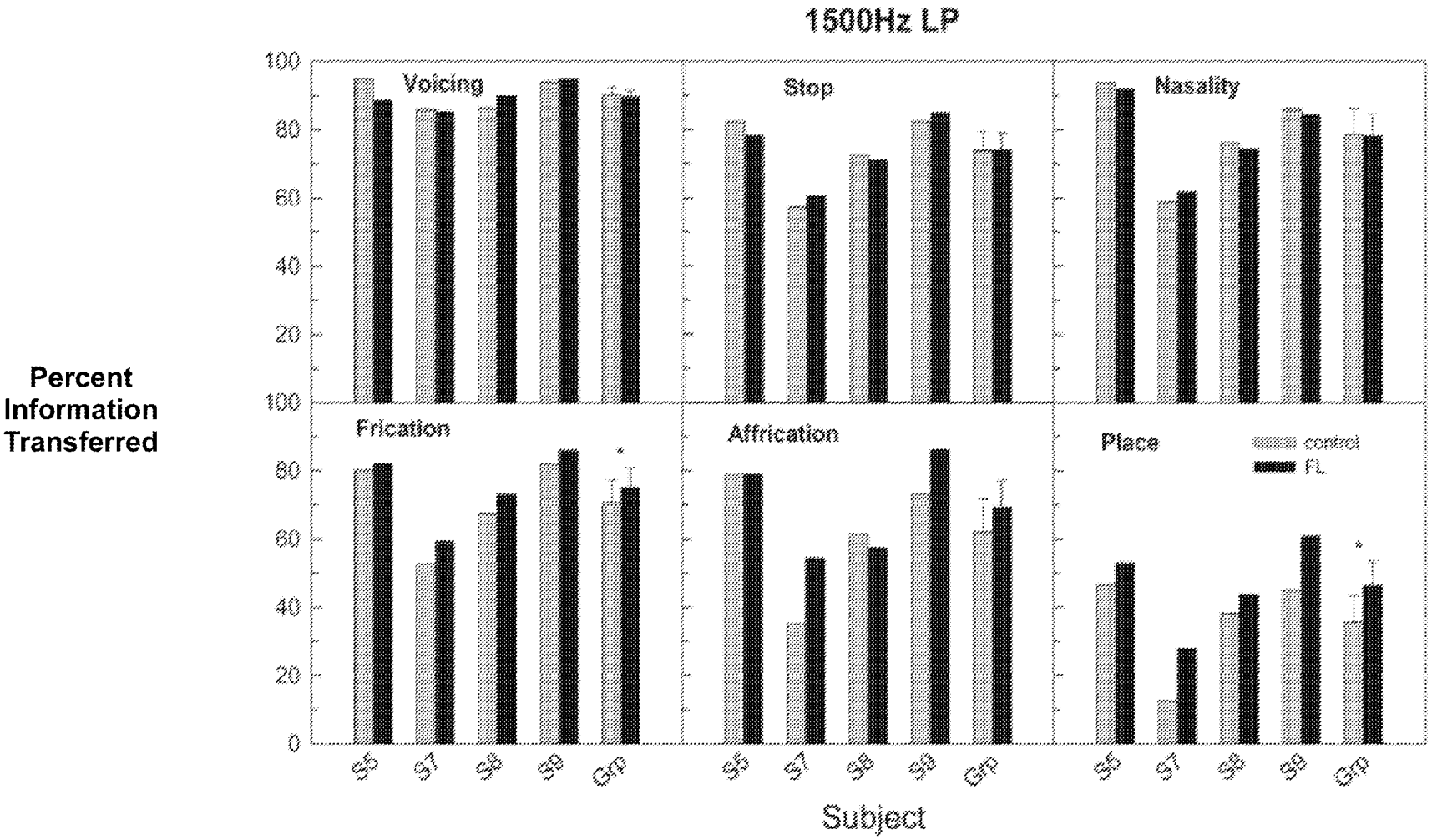
Figure 7C:
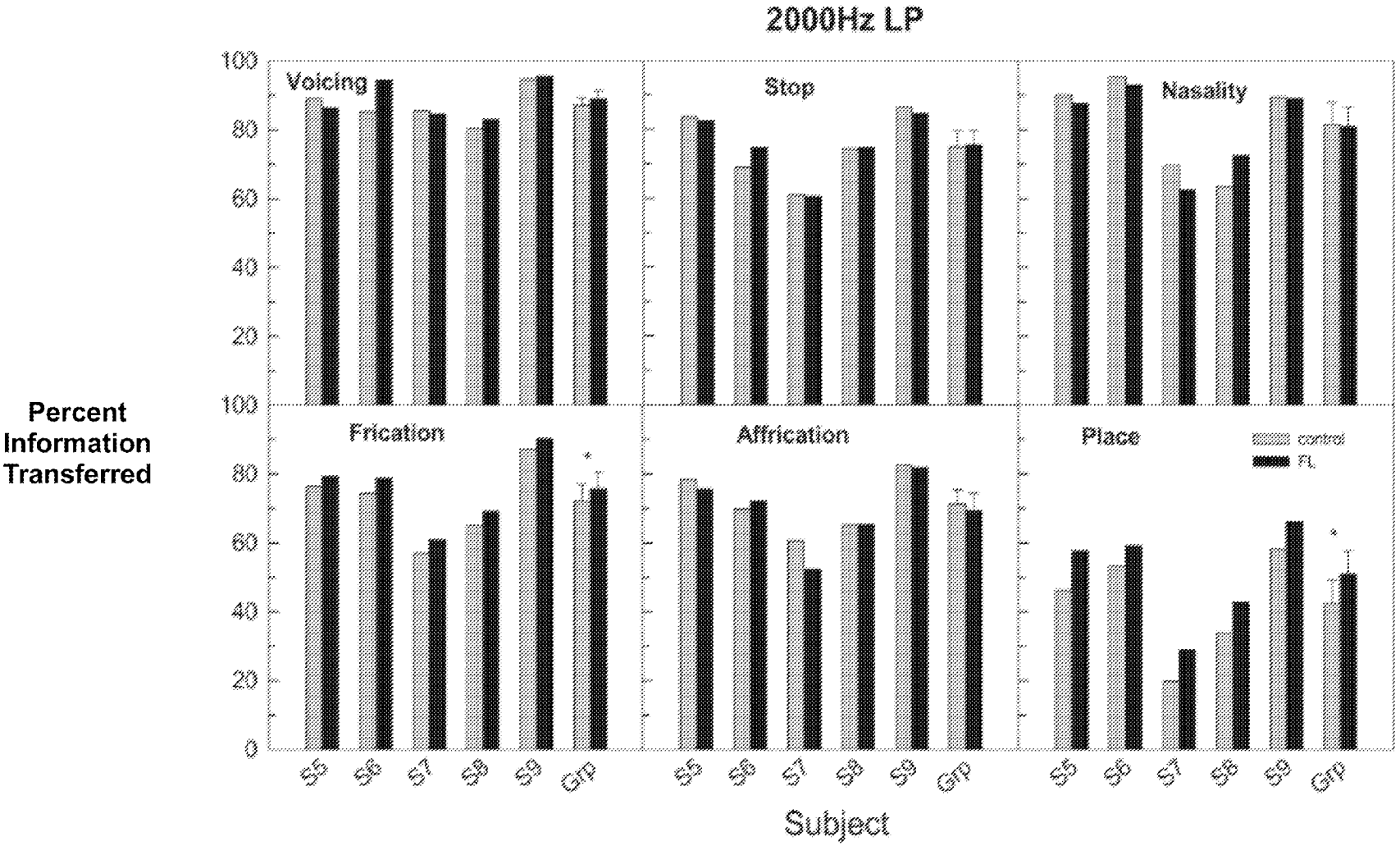

The bottom panels of FIG. 6 illustrates there was a statistically significant improvement in consonant recognition when audio signals including stops, fricatives, and affricates were processed with the system similar to system 100, and the middle panels illustrate that recognition of semivowel and nasal signals were not impaired. FIGS. 7A-7C illustrate the percent of information transferred for the six consonant features. FIGS. 7A, 7B, and 7C illustrate the results when the output signal was low-pass filtered at 1000 Hz, 1500 Hz, and 2000 Hz, respectively. FIGS. 7A-7C illustrate the perception of voicing and nasality, when processed with a system similar to system 100, was as good as that without frequency-lowering, The frequency-lowering system led to significant improvements in the amount of place information transmitted to the subject.

Accordingly, through the above-discussed systems and methods, intelligibility of speech by hearing impaired listeners may be significantly improved via conditional frequency lowering and enhancement of place-of-articulation features via combination with distinct signals corresponding to spectral features of the input audio, and may be implemented in various devices including hearing aids, computing devices, or smart phones.

What is claimed is:

1. A method for frequency-lowering of audio signals for improved speech perception, comprising:

receiving, by an analysis module of a device, a first audio signal;

detecting, by the analysis module, one or more spectral characteristics of the first audio signal, the detected one or more spectral characteristics corresponding to one or more respective non-sonorant sounds;

classifying, by the analysis module, the one or more respective non-sonorant sounds, based on the detected one or more spectral characteristics of the first audio signal;

selecting, by a synthesis module of the device, a second audio signal from a plurality of audio signals, responsive to at least the classification of the one or more respective non-sonorant sounds; and combining, by the synthesis module of the device, at least a portion of the first audio signal with the second audio signal for output to form a combined audio signal with frequency characteristics audible to the user.

2. The method of claim 1, wherein detecting one or more spectral characteristics of the first audio signal comprises detecting a spectral slope or a peak location of the first audio signal.

3. The method of claim 1, wherein detecting the one or more spectral characteristics comprises detecting the one or more spectral characteristics corresponding to the one or more non-sonorant sounds based on identifying that the first audio signal comprises an aperiodic signal above a predetermined frequency.

4. The method of claim 1, wherein detecting the one or more spectral characteristics comprises detecting the one or more spectral characteristics corresponding to the one or more non-sonorant sounds based on analyzing amplitudes of energy of the first audio signal in one or more predetermined frequency bands.

5. The method of claim 1 further comprising:

classifying the one or more non-sonorant sounds in the first audio signal as belonging to a first group of one of a predetermined plurality of groups having distinct spectral characteristics, based on a spectral slope of the first audio signal not exceeding a threshold.

6. The method of claim 1 further comprising:

classifying the one or more non-sonorant sounds in the first audio signal as belonging to a second group of one of a predetermined plurality of groups having distinct spectral characteristics, based on a spectral slope of the first audio signal exceeding a threshold and a spectral peak location of the first audio signal not exceeding a second threshold.

7. The method of claim 1 further comprising:

classifying the one or more non-sonorant sounds in the first audio signal as belonging to a third group of one of a predetermined plurality of groups having distinct spectral characteristics, based on a spectral slope of the first audio signal exceeding a threshold and a spectral peak location of the first audio signal above a predetermined frequency exceeding a second threshold.

8. The method of claim 1 further comprising:

classifying the one or more non-sonorant sounds in the first audio signal as belonging to a first, second, or third group of one of a predetermined plurality of groups having distinct spectral characteristics, based on amplitudes of energy of the first audio signal in one or more predetermined frequency bands.

9. The method of claim 1 wherein selecting the second audio signal further comprises:

selecting the second audio signal from the plurality of audio signals responsive to the classification of the one or more non-sonorant sounds in the first audio signal, each of the plurality of audio signals comprising a plurality of noise signals and each having a different spectral shape, and wherein the spectral shape of each of the plurality of audio signals is based on the relative amplitudes of each of the plurality of noise signals at a plurality of predetermined frequencies.

10. The method of claim 1 wherein each audio signal of the plurality of audio signals has a different shape, and wherein selecting the second audio signal further comprises:

selecting a given audio signal of the plurality of audio signals having a spectral shape corresponding to spectral features of a given one of the one or more non-sonorant sounds in the first audio signal, responsive to the classification of the given one of the one or more non-sonorant sounds in the first audio signal.

11. The method of claim 1, wherein combining the first audio signal with the second audio signal comprises combining at least a portion of the one or more non-sonorant sounds in the first audio signal with the second audio signal for output, the second audio signal having an amplitude proportional to a portion of the first audio signal above a predetermined frequency and wherein a portion of the second audio signal includes spectral content below a portion of the first audio signal above a predetermined frequency.

12. The method of claim 1, further comprising:

receiving, by the analysis module, a third audio signal;

detecting, by the analysis module, one or more spectral characteristics of the third audio signal;

classifying, by the analysis module, the third audio signal as a sonorant sound, based on the detected one or more spectral characteristics of the third audio signal; and outputting the third audio signal without performing a frequency lowering process.

13. A system for improving speech perception, comprising:

a first transducer for receiving a first audio signal;

an analysis module configured for:

detecting one or more spectral characteristics of the first audio signal, the detected one or more spectral characteristics corresponding to one or more respective non-sonorant sounds; and classifying the one or more respective non-sonorant sounds, based on the detected one or more spectral characteristics of the first audio signal;

a synthesis module configured for:

selecting a second audio signal from a plurality of audio signals, responsive to at least the classification of the one or more respective non-sonorant sounds; and combining at least a portion of the first audio signal with the second audio signal for output to form a combined audio signal with frequency characteristics audible to the user; and a second transducer for outputting the combined audio signal.

14. The system of claim 13, wherein the analysis module is further configured to detect the one or more spectral characteristics by detecting the one or more spectral characteristics corresponding to the one or more non-sonorant sounds based on identifying that the first audio signal comprises an aperiodic signal above a predetermined frequency.

15. The system of claim 13, wherein the analysis module is further configured to detect the one or more spectral characteristics by detecting the one or more spectral characteristics corresponding to the one or more non-sonorant sounds based on analyzing amplitudes of energy of the first audio signal in one or more predetermined frequency bands.

16. The system of claim 13, wherein the analysis module is further configured for classifying the one or more non-sonorant sounds in the first audio signal as belonging to a first group of one of a predetermined plurality of groups having distinct spectral characteristics, based on a spectral slope of the first audio signal not exceeding a threshold.

17. The system of claim 13, wherein the analysis module is further configured for classifying the one or more non-sonorant sounds in the first audio signal as belonging to a second group of one of a predetermined plurality of groups having distinct spectral characteristics, based on a spectral slope of the first audio signal exceeding a threshold and a spectral peak location of the first audio signal not exceeding a second threshold.

18. The system of claim 13, wherein the analysis module is further configured for classifying the one or more non-sonorant sounds in the first audio signal as belonging to a third group of one of a predetermined plurality of groups having distinct spectral characteristics, based on a spectral slope of the first audio signal exceeding a threshold and a spectral peak location of the first audio signal above a predetermined frequency exceeding a second threshold.

19. The system of claim 13, wherein the analysis module is further configured for classifying the one or more non-sonorant sounds in the first audio signal as belonging to a first, second, or third group of one of a predetermined plurality of groups having distinct spectral characteristics, based on amplitudes of energy of the first audio signal in one or more predetermined frequency bands.

20. The system of claim 13, wherein the synthesis module is further configured for selecting the second audio signal from the plurality of audio signals responsive to the classification of the one or more non-sonorant sounds in the first audio signal, each of the plurality of audio signals comprising a plurality of noise signals and each having a different spectral shape, and wherein the spectral shape of each of the plurality of audio signals is based on the relative amplitudes of each of the plurality of noise signals at a plurality of predetermined frequencies.

21. The system of claim 13, wherein the synthesis module is further configured for combining at least a portion of the one or more non-sonorant sounds in the first audio signal with the second audio signal, the second audio signal having an amplitude proportional to a portion of the first audio signal above a predetermined frequency and wherein a portion of the second audio signal includes spectral content below a portion of the first audio signal above a predetermined frequency.

* * * * *